United States Patent [19]

Storm et al.

[11] Patent Number: 4,628,671

[45] Date of Patent: Dec. 16, 1986

[54] APPARATUS FOR PACKING PRODUCE, SUCH AS LETTUCE, BUNCHES OF CARROTS, ASPARAGUS, BANANAS AND THE LIKE

[76] Inventors: Werner Storm; Volker Storm, both of Delle 8, 2000 Hamburg 65, Fed. Rep. of Germany

[21] Appl. No.: 767,474

[22] Filed: Aug. 20, 1985

[30] Foreign Application Priority Data

Aug. 30, 1984 [DE] Fed. Rep. of Germany ... 8425616[U]

[51] Int. Cl.[4] ..... B65B 13/04

[52] U.S. Cl. ..... 53/588; 53/210

[58] Field of Search ..... 53/556, 587, 588, 210

[56] References Cited

U.S. PATENT DOCUMENTS

| | | | |
|---|---|---|---|
| 2,624,990 | 1/1953 | Allen | 53/588 X |
| 2,945,336 | 7/1960 | Anderson | 53/588 |
| 4,461,136 | 7/1984 | Hudson | 53/587 X |

FOREIGN PATENT DOCUMENTS

| | | | |
|---|---|---|---|
| 2164038 | 7/1973 | Fed. Rep. of Germany | 53/210 |
| 3236438 | 4/1984 | Fed. Rep. of Germany | 53/588 |

*Primary Examiner*—John Sipos

*Attorney, Agent, or Firm*—Trexler, Bushnell & Wolters, Ltd.

[57] ABSTRACT

In order to be able to economically package with foil banderoles e.g. lettuces and bunches of carrots, asparagus, bananas, etc, the packaging apparatus has technical means for holding and grasping the foil web end, so that on removing the web from the foil web storage drum it can be placed round the article to be packaged and the foil web end can be kept within hand reach for new packaging processes. To this end, the foil web, together with its foil web storage drum is wound by means of a swivel round the article to be packaged, between two successive trays having a gap between them, the two ends of the article being supported on the trays. The gripping of the foil web end takes place by means of two foil web ends holding tubes, which are provided with circumferentially distributed air intakes and are connected to a vacuum producing device which can be switched on and off. The foil web is separated by means of a cutting knife.

3 Claims, 3 Drawing Figures

APPARATUS FOR PACKING PRODUCE, SUCH AS LETTUCE, BUNCHES OF CARROTS, ASPARAGUS, BANANAS AND THE LIKE

BACKGROUND OF THE INVENTION

The present invention relates to an apparatus for the packaging of produce, such as lettuces and bunches of carrots, asparagus, bananas, etc. by wrapping the produce with a banderole of a plastic foil, film or sheet and in particular an extensible foil.

Apart from the complete wrapping of an article with foil, which envelops the article completely, the partial wrapping by means of a banderole is known, which does not completely envelop the article and instead leaves two facing sides open. The construction of the known apparatuses for wrapping articles with banderoles in very complicated and expensive, because on the one hand the foil web must be guided around the article and on the other it is necessary at the end of the packaging process to bring the foil web into a position correct for gripping, where it is held, so that for the following packaging process, the foil web end can be grasped and placed around the article to be packaged.

SUMMARY OF THE INVENTION

The inventon solves the problem of providing an economically operating apparatus for the inexpensive packaging of produce with a foil banderole, which permits the packaging of lettuces and bunches of bananas, carrots, asparagus, etc., so that prices can be applied to the banderole and in which the particular foil web end is held in such a way that wrapping processes can be carried out without additional techncial means.

The invention specifically relates to a packaging apparatus, wherein in a supporting frame are provided two longitudinally succeeding trays, arranged at a distance from one another so as to form a gap and receiving the article to be packaged with its end regions, a swivel revolving about a rotation axis parallel to the tray longitudinal axis by means of a drive means by at least one full and one half revolution, in order to revolve one of the two trays in its end region, facing the gap and which is guided between bearing and guide rollers and which carries a laterally projecting, rod-like mounting support parallel to the swivel rotation axis with a foil web storage drum common to the swivel and revolving about the gap between the two trays, two longitudinally succeeding foil web holding tubes positioned below the trays and in the inner area of the swivel and connected via flexible hoses to a vacuum producing means with an on/off valve, the facing ends of said tubes located below the foil web storage drum being provided with circumferentially distributed air intakes and which are constructed as spindles guided in fixed guides and for moving in the spindle longitudinal direction are connected to the piston rods of two working cylinders or other suitable drive means, a cutting knife introducible into the packaging material foil warpping area, a drive means, as well as a control device, in which are brought together the drive means for the swivel with the foil web storage drum, the working cylinders for the foil web holding tubes the on/off valve for the vacuum producing means and the drive means for the cutting knife.

Such an apparatus permits the economic packaging of produce with a foil banderole. The apparatus in particular makes it possible to provide lettuces and bunches of carrots, asparagus, bananas, etc. with a foil banderole, which can be provided with price details, and in fact during the production of the pack, the foil web used can be then provided with corresponding price details. However, it is also possible to subsequently print on or apply price details to the applied foil banderole.

The apparatus operates very economically, because it has a simple construction and only little foil is required for the packaging process, so that ultimately an inexpensive pack is obtained.

The foil web end is held or grasped with the simplest technical means, so that when the foil web is drawn from a foil storage drum it can be placed around the article to be packaged and after separating the foil web portion placed around the article from the actual foil web, its end is kept within hand reach for carrying out a new packaging process. There is no need for additionally pressing the end of the foil web portion placed around the article following its separation from the foil web, because the foil web portion end is automatically applied to the foil envelope of the article, whilst simultaneously the free foil web end is held by means of vacuum on two foil web holding tubes. The release of the free end of the foil web following the wrapping of an article takes place by separating the foil web holding tube and simultaneously rotating said tubes about their longitudinal axes. Only through this sequence of motions is it possible to detach the foil web from the holding tubes which are under a vacuum, without the foil web sliding, collapsing, etc.

It is particularly advantageous to package lettuces with the foil banderole using the apparatus, because in this way a lettuce pack is obtained making it possible to avoid the hitherto encountered disadvantage when selling lettuces that only through complicated auxiliary means is it possible to keep them fresh for a long period. The foil banderoles used do not rot and permit the storage and keeping of lettuces packed in this way in water-contining containers or tubs. When using the apparatus, there is also only a limited foil consumption, because only a minimum foil quantity is used for wrapping purposes.

Advantageous developments of the invention are characterized in the subclaims.

BRIEF DESCRIPTION OF THE DRAWINGS

The invention is described in greater detail hereinafter relative to non-limitative embodiments and the attached drawings, wherein show.

Figure 1:
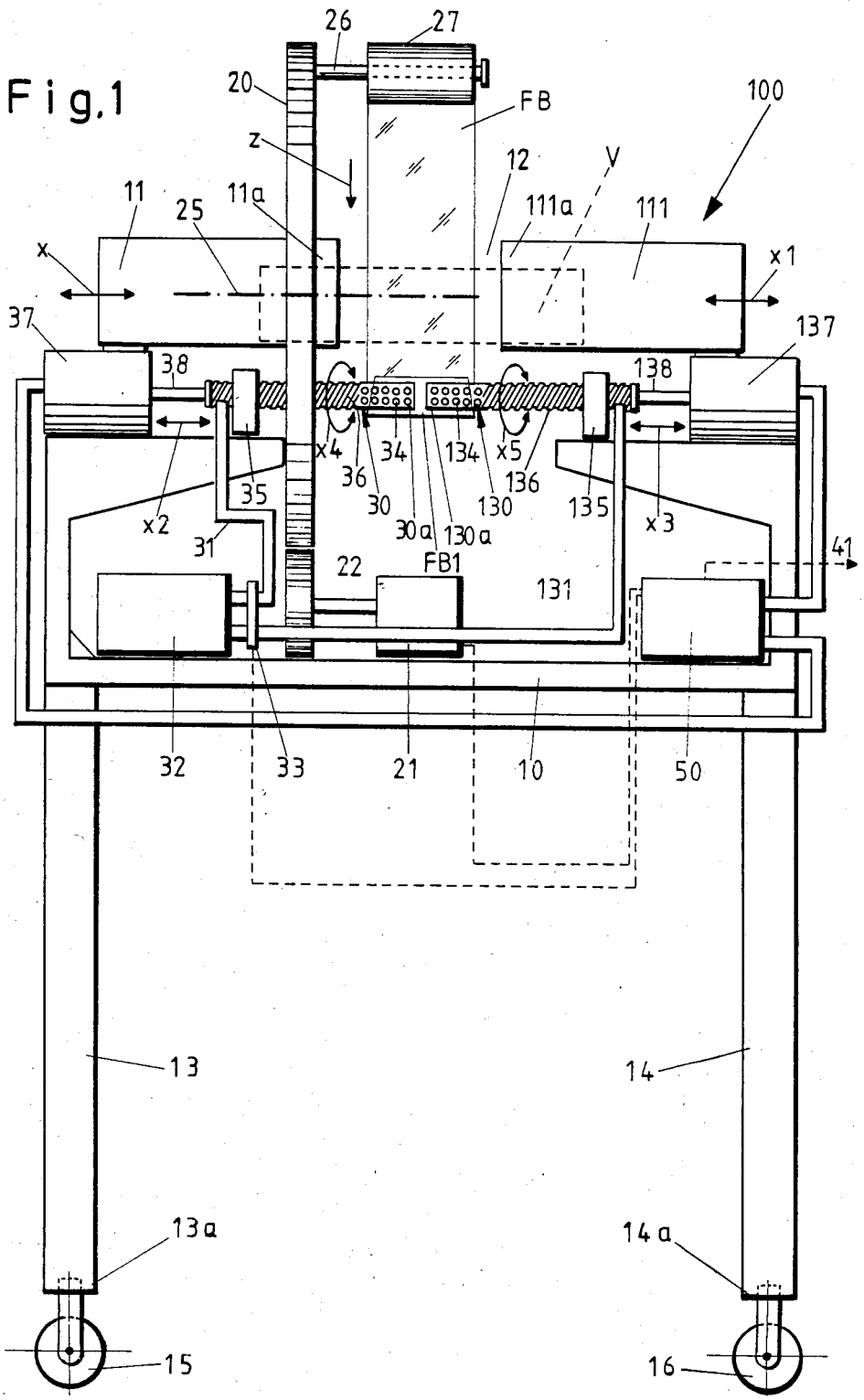
FIG. 1 a view from the front of the packaging apparatus.
Figure 2:
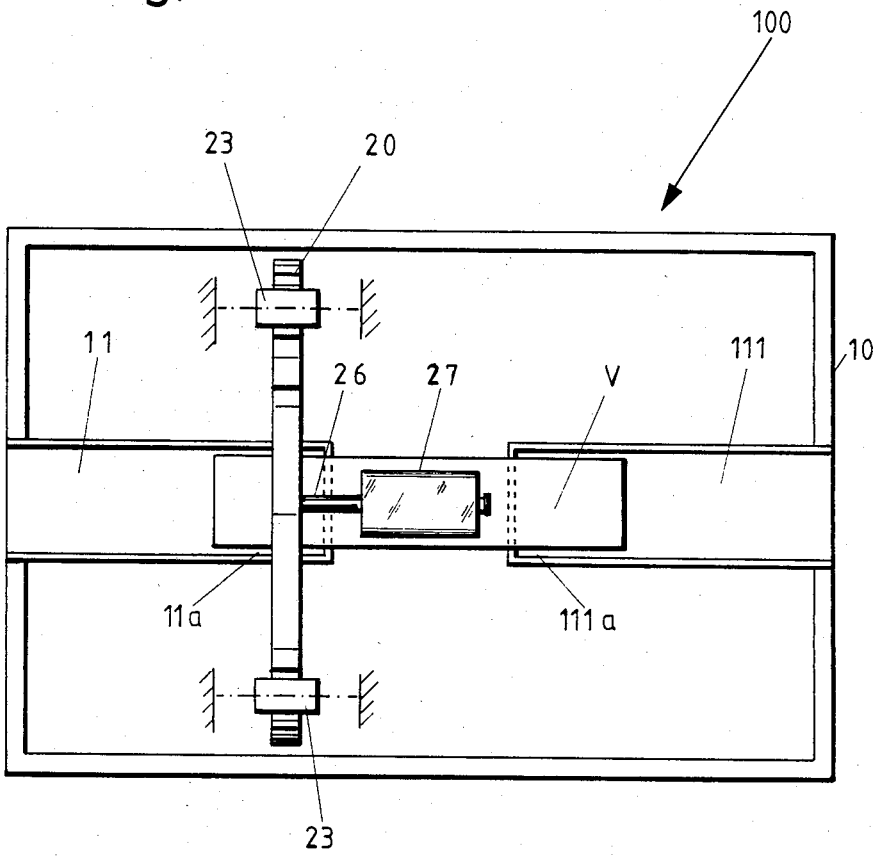
FIG. 2 a view from above of the packaging apparatus.

Apparatus 100 shown in FIG. 1 for packaging produce, such as lettuces, bunches of carrots, asparagus, bananas, etc. comprises a supporting frame 10, which can be provided with posts 13, 14, which carry at their bottom ends 13*a*, 14*a* runners 15, 16, so that the packaging apparatus 100 can be moved to another place of use.

With in the supporting frame 2, two trays 11, 111 are arranged in longitudinally succeeding manner and between the facing ends 11*a*, 111*a*, trays 11, 111 is formed a gap 12. In order to be able to modify the width of gap 12, the trays 11, 111 are slidingly held in supporting frame 10 in guides which are not shown in the drawing.

The trays 11, 111 can be secured in their positions by using fixing means, such as clamping or locking means, connected in per se known manner. The two trays 11, 111 are constructed as half-trays, so that the article to be packaged can be placed therein in such a way that the end regions of article V come to rest in trays 11, 111, whilst the central region of article V is located in the gap 12 between the trays 11, 111. The displaceability of the two trays 11, 111 for modifying the size of the gap 12 is indicated by arrows X, X1 in FIG. 1.

Figure 3:
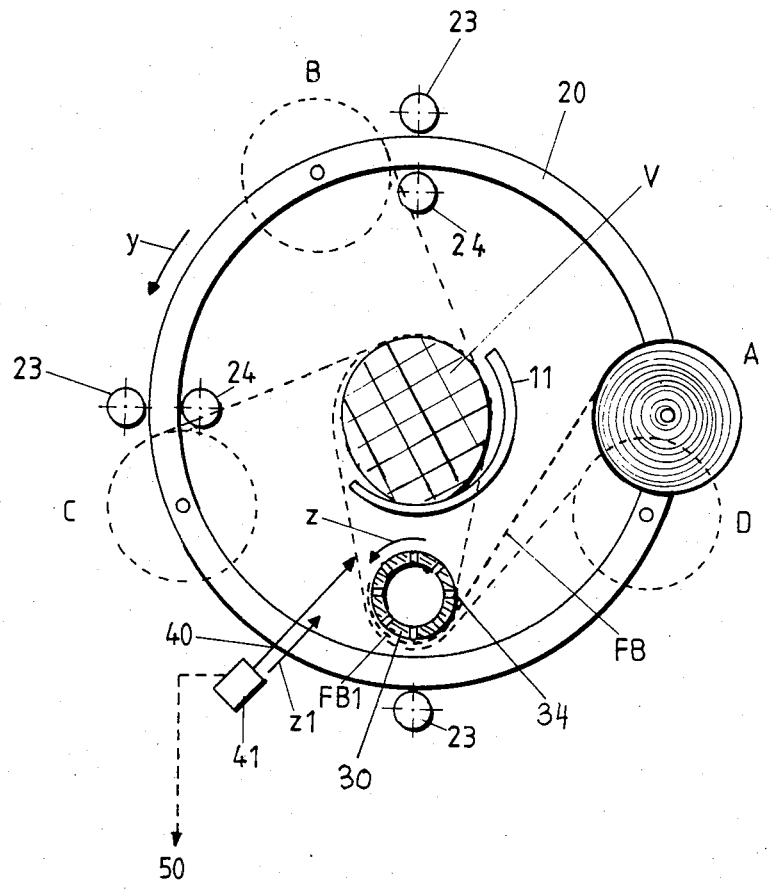
FIG. 3 a diagrammatic side view of the packaging process.

Supporting frame 10 contains a vertically standing swivel 20, which is guided and held in outer and inner bearing and guide rollers 23, 24, (FIG. 3). These bearing and guide rollers 23, 24 are held on supporting frame 10. The arrangement of swivel 20 in supporting frame 10 is such that its rotation axis indicated at 25 is parallel to the longitudinal axis of trays 11, 111. In addition, swivel 20 revolves around one of the two trays 11, 111. In the embodiment of FIG. 1, swivel 20 is arranged with respect to tray 11 in such a way that the front region 11*a* of tray 11 comes to rest in the inner area of swivel 20, i.e. the latter revolves around the end region 11*a* of tray 11 and is consequently positioned in supporting frame 10 so as to be laterally displaced with respect to gap 12. Thus, trays 11 and 111 are positioned in the vicinity of rotation axis 25 of swivel 20.

Swivel 20 can be rotated about its rotation axis 25 in the direction of arrow Y by means of a drive means 21 (FIG. 3). The drive means 21 can be an electromotive drive, but other drive means can also be used. Driving gear 22 located on the driving means shaft is in operative connection with swivel 20, so as to be able to revolve the same. However, it is also possible to construct one or other of the bearing and guide rollers 23, 24 as a drive roller, and to connect same to a corresponding drive.

Swivel 20 carries a laterally projecting rod-like mounting support 26 running parallel to its rotation axis 25, in the form of a bearing spindle for a storage drum 27 for a foil web FB. This foil web storage drum 27 is provided with a removal brake, e.g. a friction brake constructed in per se known manner, so as to avoid when removing foil in the direction of arrow Z, as a result of the free-wheeling of the storage drum, no more foil web than is necessary is supplied.

The foil supply on drum 27 consists of a web of a plastic foil, particularly an extensible foil. The overall arrangement of the coil web storage drum 27 in conjunction with the swivel 20 is such that the foil web FB can be passed between the two trays 11, 111. The width of foil web FB is slightly less than the width of gap 12 between the two trays 11, 111. The foil web width will in all cases depend on the packaging article length and the in each case desired pack width. Due to the fact that the two trays 11, 111 are displaceable in supporting frame 10 for varying the size of gap 12, it is possible to use wider or narrower foil webs, so that the in each case most favourable foil web width can be used, as a function of the article to be packaged.

Below the trays 11, 111 in supporting frame 10 are provided two holding tubes 30, 130, which serve to secure the foil web end FB1. These holding tubes 30, 130 are arranged successively corresponding to the trays 11, 111, so that their central longitudinal axes are aligned with one another. The arrangement of these holding tubes 30, 130 is such that their facing ends 30*a*, 130*a* are located below the gap 12 below the trays 11, 111, as shown in FIG. 1.

Each of the two holding tubes 30, 130 is provided at the end 30*a* or 130*a* with a plurality of air intakes 34, 134 distributed over its circumference. In addition, each holding tube 30 or 130 is connected via a flexible hose 31, 131 with a vacuum producing device 32 arranged in supporting frame 10 and provided with an on/off valve 33.

The two holding tubes 30, 130 are held in laterally movable manner in supporting frame 10, so that the free holding tube ends 30*a*, 130*a* with their intakes 34, 134 can be moved out of the area of foil web FB.

This lateral moving apart of the two holding tubes 30, 130, working cylinders 37, 137 are provided in supporting frame 10, which are e.g. operated hydraulically or with compressed air. However, it is also possible to use other suitable drive means.

The piston rods 38, 138 of the two working cylinders 37, 137 are so connected with the ends of the holding tubes 30, 130 remote from the holding tube ends 30*a*, 130*a* carrying the air intakes 34, 134, that in the case of a corresponding actuation of working cylinders 37, 137, piston rods 38, 138 with their holding tubes 30, 130 can be moved in the direction of arrows X2, X3 (FIG. 1) and the holding tubes can rotate about their longitudinal axes.

So as to be able to detach the foil web end FB1 from holding tube ends 30*a*, 130*a* when vacuum is applied, holding tubes 30, 130 are constructed in such a way that on moving apart they simultaneously rotate about their longitudinal axes in the direction of arrows X4, X5. This rotation of holding tubes 30, 130 about their longitudinal axes takes place through a spindle-like construction of the two holding tubes 30, 130. On their outer circumference, the two holding tubes 30, 130 are constructed as spindles 36, 136, i.e. with thread-like guides and are also guided in fixed guides 35, 135 in such a way that on moving apart the tubes 30, 130, the latter rotate about their longitudinal axes. As a result of this rotation of holding tubes 30, 130, it is possible to release the foil web end FB1 from the holding position at the ends 30*a*, 130*a* of holding tubes 30,130.

In addition, in supporting frame 10 is provided a cutting knife 30 or some other suitable foil separating means, (FIG. 3). Cutting knife 40 is connected to a drive means 41 enabling knife 40 to be introduced into the necessary cutting area enabling the foil banderole to be separated from the foil web FB after applying said banderole to the article to be packaged.

All the drive means of the packaging apparatus 100 are brought together in a control device 50 enabling the individual motion sequences to be controlled. Thus, within control device 50 are brought together the drive means 21 for swivel 20 with the foil storage drum 27, working cylinders 37, 137 for holding tubes 30, 130, on/off valve 33 for the vacuum producing device 32 and drive means 41 for cutting knife 40. (FIG. 1).

Packaging apparatus 100 functions as follows: After placing the foil web storage drum 27 on the bearing spindle 26 in swivel 20, vacuum producing device 32 is put into operation, so that air is sucked through openings 34, 134 at the ends 30*a*, 130*s*. of holding tubes 30, 130. In the starting position, the two holding tubes 30, 130 are located in the manner shown in FIG. 1 below gap 12 between the two trays 11, 111. The article V to be packaged is placed in trays 11, 111 in such a way that the end regions of article V come to rest in trays 11, 111. The central free region of article V is then located in gap 12.

The foil web is manually removed in the direction of arrow Z from the foil storage drum 27 to such an extent that the foil web end FB1 comes to rest in the vicinity of ends 30*a*, 130*a* of holding tubes 30, 130, a portion of said end FB1 being placed round the holding tube end 30*a*,130*a*. (FIG. 3). Due to the fact that the holding tubes 30 and 130 are connected to the vacuum producing device 32, the foil web end FB1 is held on holding tubes 30, 130 by means of the air intakes 34, 134 at holding tube ends 30*a*, 130*a*. On the basis of the position of swivel 20 within foil web storage drum 27 shown at A in FIG. 3, by means of the control device 50 in conjunction with the drive means 21 for swivel 20, the latter is revolved in the direction of arrow Y. Foil web storage drum 27 participates in this rotation of swivel 20 and is moved via positions B, C and D into the starting position A, the foil web FB being placed around article V and around the ends 30*a*, 130*a* of holding tubes 30, 130. As the two holding tubes 30, 130 have the closed position shown in FIG. 1, on revolving the foil web storage drum 27 the foil web is not only placed around the article V, but in the lower region thereof is also placed around the end 30*a*, 130*a* of holding tubes 30, 130, when e.g. swivel 20 with its foil web storage drum 27 reaches position D in FIG. 3.

During the rotation of swivel 20 with its foil web storage drum 27 from position A via positions B and C to position D, only that quantity of foil web is removed from drum 27 as is required for the wrapping process of article V, accompanied by the simultaneous guidance of the web around the holding tube ends 30*a*, 130*a*. The removal break in operative connection with the foil web storage drum 27 ensures that no more foil web than is necessary is removed from the drum.

When the foil web storage drum 27 has reached position D (FIG. 3), then the two working cylinders 37, 137 are switched on, so that the two holding tubes 30, 130 move apart, accompanied by the simultaneous rotation of tubes 30, 130 in the direction of arrow Z, so that on moving apart said tubes, and the simultaneous rotary movement about the longitudinal axes thereof, foil web end FB1 is detached from the holding tube ends 30*a*, 130*a* which is possible as a result of these rotary movements, because throughout the complete process the vacuum producing device 32 is switched on and air is sucked through intakes 34, 134 in holding tube ends 30*a*, 130*a*. During the moving apart, holding tubes 30, 130 preferably rotate in opposite directions. After the two holding tubes 30, 130 have been moved apart, in a position where the holding tube ends 30*a*, 130*a* are located outside foil web FB, swivel 20 is simultaneously moved on in the direction of arrow Y, so that its foil web storage drum 27 is also advanced, so that the foil web is applied to article V to be packaged or is drawn on to the same because for this application of the web to the article there is a free path through the moved apart holding tubes 30, 130.

At the time when the foil web is applied to the lower region of article V, the two holding tubes 30, 130 are moved together again into the closed position shown in FIG. 1 by means of working cylinders 37, 137. The vacuum producing device 32 can be placed temporarily out of operation by means of the on/off valve, because initially the holding tubes 30, 130 do not have to hold a foil web end.

From position D or A in FIG. 3, foil web storage drum 27 during a further rotation of swivel 20 again runs around the article V until roughly position D is again reached. However, since during this rotation up to position D, the two holding tubes 30, 130 have again had the closed, i.e. moved together positions shown in FIG. 1, the foil web passes over a portion of the outer circumference of the two holding tube ends 30*a*, 130*a*. At this instant, the vacuum producing device 32 is put into operation again, so that the foil web is subject to suction action in the engagement region on the holding tube ends 30*a*, 130*a* and is secured by the latter. During this process, cutting knife 40 is moved by means of drive means 41 into the foil web region in the direction of arrow Z1 and cuts the web from the foil web portion wrapping article V. The free end FB1 of foil web FB is held by the holding tube ends 30*a*, 130*a*, whilst the free end of that foil web portion which is exposed by cutting from foil web FB is applied to the foil web portion already enveloping the article V. This application of the free end of the foil web portion is placed round article V takes place automatically, as a result of the adhesive forces between this foil web end and the foil web portion placed round the article V to be packaged.

The article V is consequently wrapped in banderole-like manner, i.e. packaged and is removed from the two trays 11, 111, whilst simultaneously the rotary movement of swivel 20 is interrupted. A new article to be packaged is placed in trays 11, 111 in the same way. The packaging process can start afresh as described hereinbefore, because the free end FB1 of foil web FB is held by holding tubes 30, 130.

What is claimed is:

1. Machine for packaging small articles, such as produce and the like, by enveloping the article with a strip of material, said machine comprising a support frame (10), spaced apart trays (11, 111) forming a gap (12) and which trays receive the end areas of an article (V) to be packaged, a ring (20) rotatable about an axis (25) parallel to the trays, a drive mechanism (21) for rotating said ring, said ring being located adjacent to said gap (12), said ring being guided between bearing and guide rollers (23, 24) and said ring carrying a laterally projecting, rod-like support (26) for a roll of strip material and said rod being parallel to the axis of rotation of said ring (25) and being rotatable with the rotary ring (20) about said gap (12), a holding device for said material between the article and the circular path of the support (26), said holding device being controllable forwards and backwards relative to a zone of wrapping, a cutting knife (40) adapted for separating the wrapping strip from the material strip portion surrounding the article to be packaged, drive means (41) for said knife, characterized in that the holding device for the free material strip end comprises two longitudinally aligned finger-like material strip end holding tubes (30, 130), positioned below the trays (11, 111) and within the rotary ring (20), vacuum producing means (32), hose lines (31, 131) connecting said tubes to said vacuum producing means (32), a controllable on-off valve (33) for said vacuum producing means, said tubes having facing ends provided with circumferentially distributed air intake ports (34, 134) and defining spindles (36, 136), said spindles being guided in fixed guides (35, 135), said tubes being connected to piston rods (38, 138) forming parts of two working cylinders (37, 137) for reciprocating and rotating said holding tubes, the tubes (30, 130) externally having thread-like guides constructed so and arranged that the rotary movements of the holding tubes (30, 130) oppose one another, control means (50) cooperable with the drive mechanism (21) for the rotary ring (20);

the cylinders (37, 137), the on-off valve (33) and the drive mechanism (41) for the cutting knife (40), for enveloping the article to be packaged and the holding tubes by moving the material of the strip from an initial position through at least one revolution of a material strip roll on said support (26), the finger-like holding tubes (30, 130) are caused to be moved sufficiently far apart for the tube ends to be located on either side of the material strip, so that the material strip held taut by the material strip roll (27) is engaged on the article to be packaged, on further rotation of said ring, and again moving together the finger-like holding tubes (30, 130) below the enveloped article so that as the material strip roll (27) is again guided around said article, the material strip envelopes from the outside the closed holding tubes (30, 130) until the strip roll (27) has again reached its initial position, and for actuating said cutting means to cut the strip and separate the article to be packaged and already enveloped with the material strip and the enveloped holding tubes (30, 130) and thereby forming a new free end of the material strip of roll (27) again secured by said holding tubes (30, 130).

2. Device according to claim 1, characterized in that the spacing between the two trays (11, 111) in the support frame (10) can be varied.

3. Device according to claims 1 or 2, characterized in that the supporting frame (10) is provided with struts (13, 14) carrying runners (15, 16) on its bottom ends (**13*a*, 14*a***).

* * * * *